US011719388B2

(12) United States Patent
Givoloup

(10) Patent No.: US 11,719,388 B2
(45) Date of Patent: Aug. 8, 2023

(54) THERMALLY INSULATING SEALED TANK

(71) Applicant: GAZTRANSPORT ET TECHNIGAZ, Saint Remy les Chevreuse (FR)

(72) Inventor: Hilarion Givoloup, Saint Remy les Chevreuse (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 133 days.

(21) Appl. No.: 17/437,335

(22) PCT Filed: Mar. 25, 2020

(86) PCT No.: PCT/EP2020/058436
§ 371 (c)(1),
(2) Date: Sep. 8, 2021

(87) PCT Pub. No.: WO2020/193665
PCT Pub. Date: Oct. 1, 2020

(65) Prior Publication Data

US 2022/0146049 A1 May 12, 2022

(30) Foreign Application Priority Data

Mar. 26, 2019 (FR) ..... 1903169

(51) Int. Cl.
*F17C 3/04* (2006.01)
*F17C 13/00* (2006.01)
*F17C 3/02* (2006.01)

(52) U.S. Cl.
CPC ..... *F17C 13/004* (2013.01); *F17C 3/027* (2013.01); *F17C 2201/0157* (2013.01);
(Continued)

(58) Field of Classification Search
CPC ..... F17C 3/027; F17C 2203/0358; F17C 2270/0107; F17C 1/12; F17C 1/002
See application file for complete search history.

(56) References Cited

U.S. PATENT DOCUMENTS

2017/0152993 A1* 6/2017 Sassi ..... F17C 13/004

FOREIGN PATENT DOCUMENTS

FR 2991430 A1 12/2013
FR 3049678 A1 10/2017
(Continued)

OTHER PUBLICATIONS

International Search Report for corresponding PCT application No. PCT/EP2020/058436, dated Jun. 8, 2020.

*Primary Examiner* — Stephen J Castellano
(74) *Attorney, Agent, or Firm* — Notaro, Michalos & Zaccaria P.C.

(57) ABSTRACT

A thermally insulating sealed tank including a bottom wall (2) attached to a supporting wall (1), the bottom wall (2) including: a sealing membrane (3) comprising a plurality of welded corrugated metal sheets, a thermally insulating barrier (4), the sealing membrane (3) and the thermally insulating barrier (4) being interrupted in a singular zone by a window (7), the tank comprising a hollow structure (15) inserted into the window (7), the hollow structure (15) being arranged through the body of the tank wall (2), wherein the tank (71) includes a metal closure plate (23), the metal closure plate (23) comprising an inner edge (24) welded all around the hollow structure (15), the metal closure plate (23) including an outer edge (25) placed under the sealing membrane (3) so as to form an overlapping area, is disclosed.

17 Claims, 5 Drawing Sheets

(52) U.S. Cl.
CPC *F17C 2201/052* (2013.01); *F17C 2203/0358* (2013.01); *F17C 2205/018* (2013.01); *F17C 2221/033* (2013.01); *F17C 2223/0161* (2013.01); *F17C 2223/033* (2013.01); *F17C 2260/011* (2013.01); *F17C 2270/0107* (2013.01)

(56) References Cited

FOREIGN PATENT DOCUMENTS

| | | | |
|---|---|---|---|
| WO | 2011157915 | A | 12/2011 |
| WO | 2016001142 | A1 | 1/2016 |

* cited by examiner

[Fig. 1]
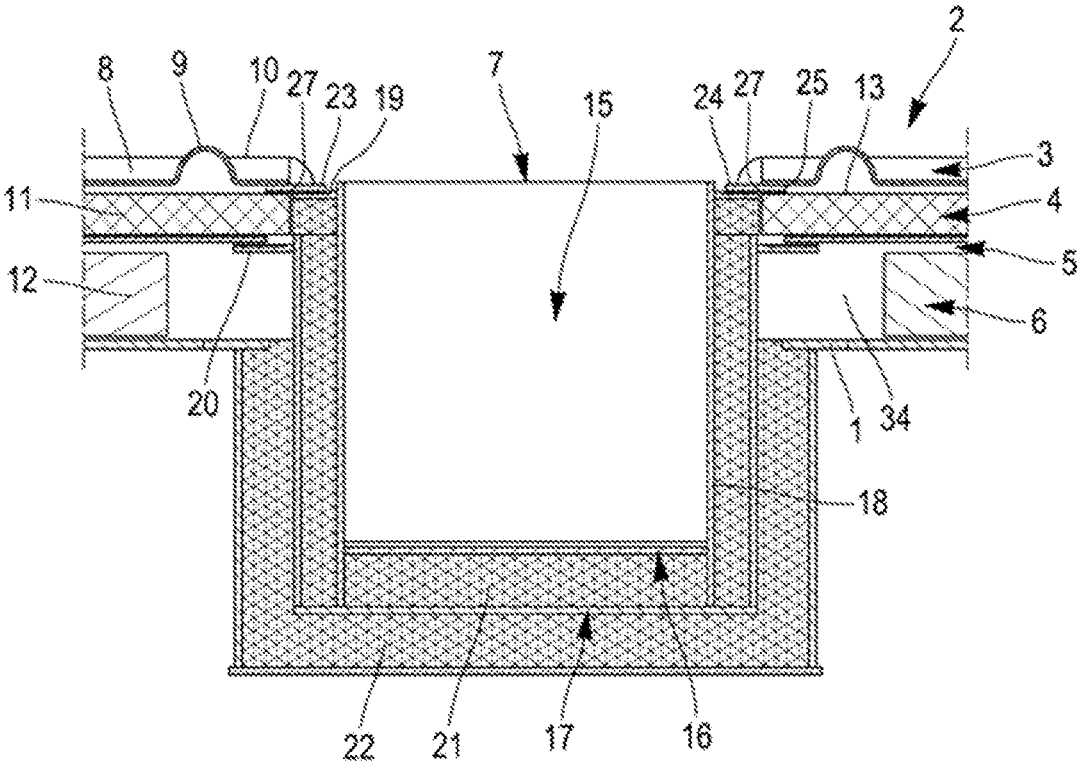

[Fig. 2]
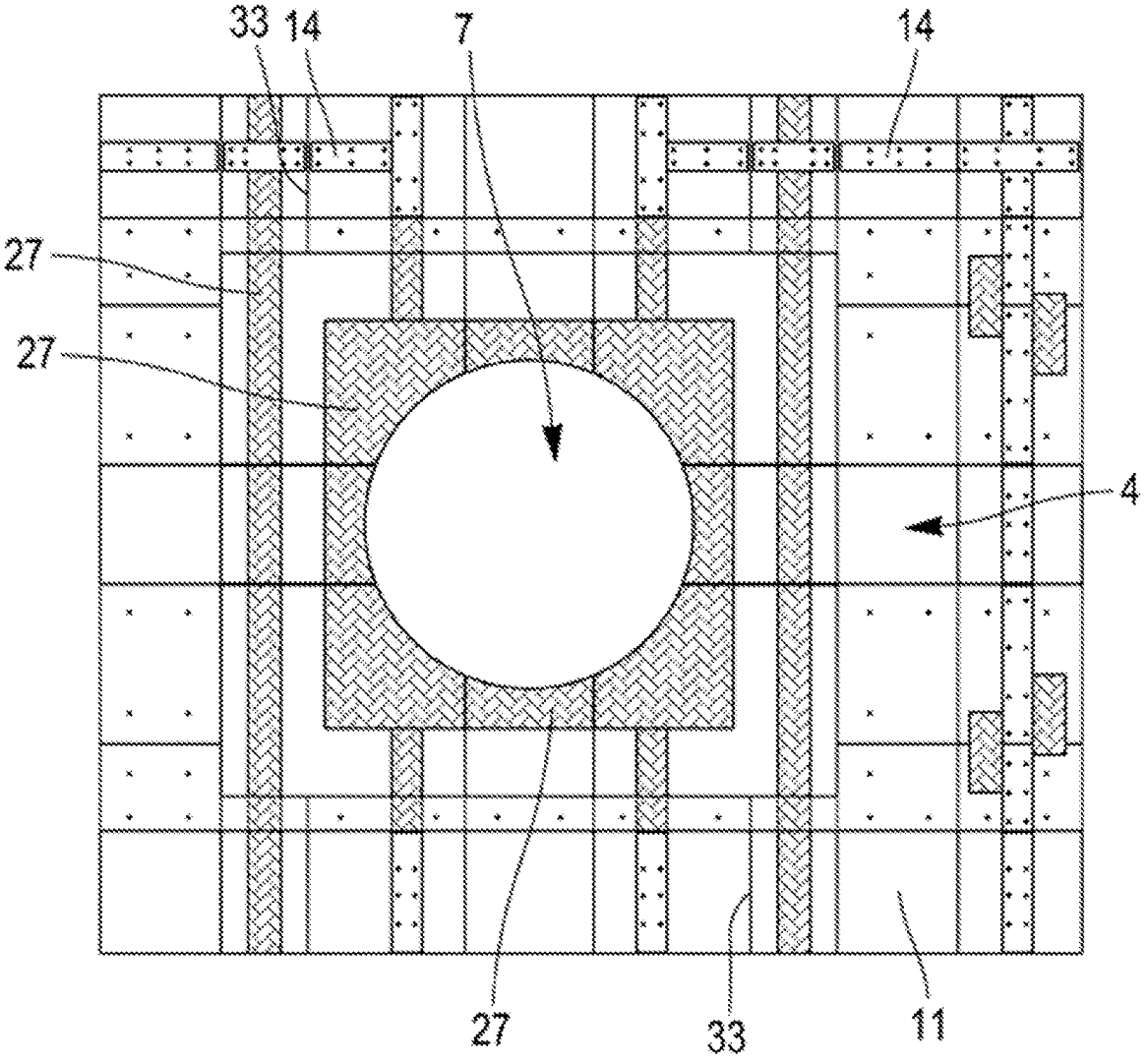

[Fig. 3]
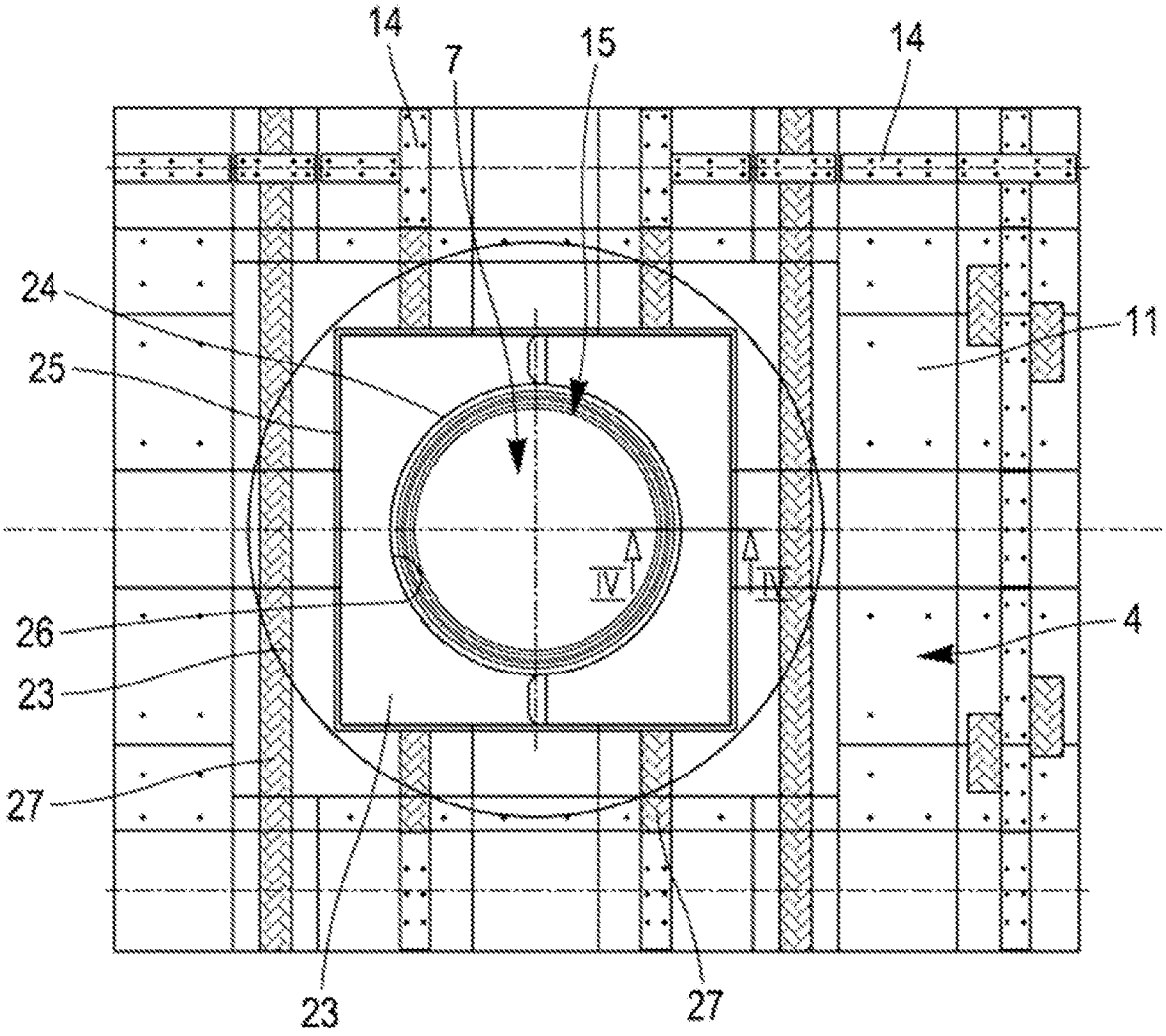

[Fig. 4]
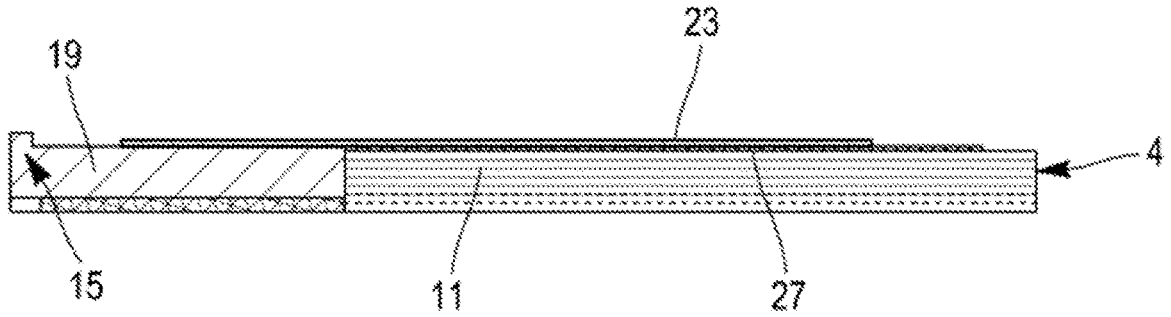
[Fig. 5]
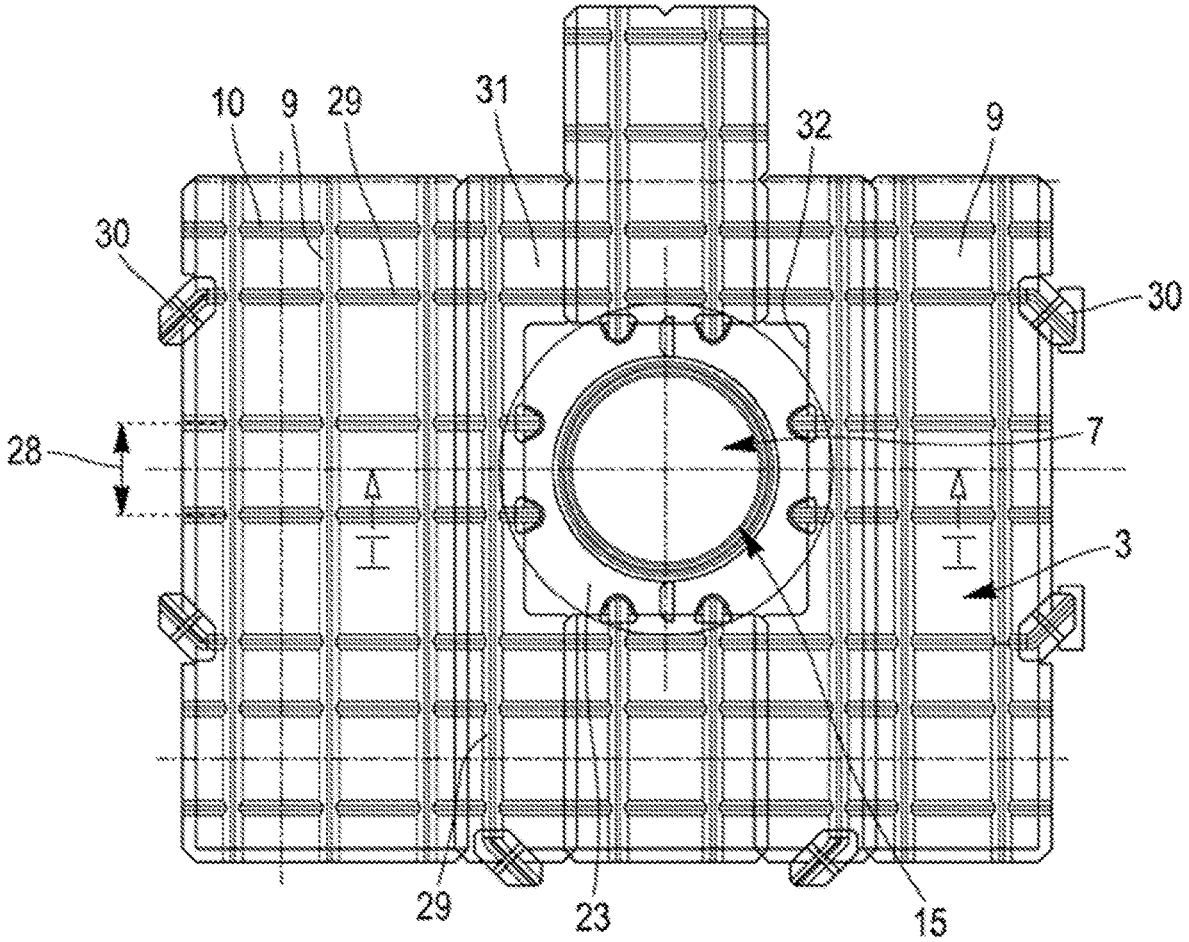

[Fig. 6]
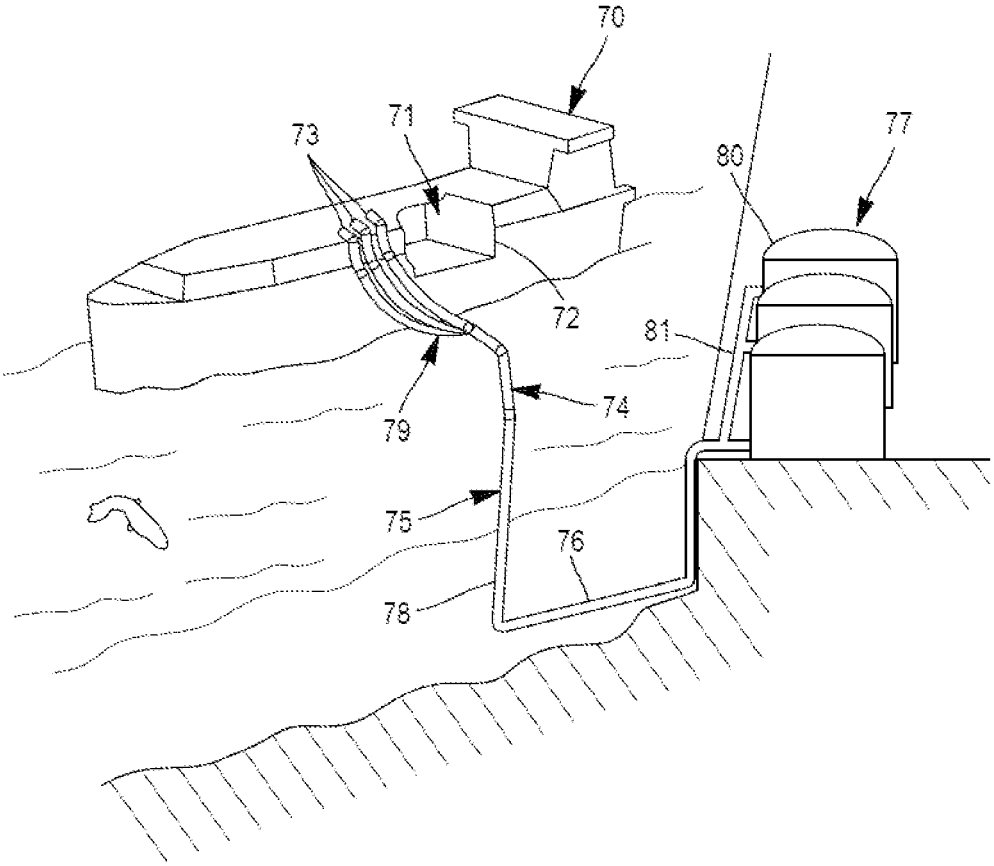

THERMALLY INSULATING SEALED TANK

This application is the national stage (Rule 371) of international application No. PCT/EP2020/058436 filed 25 Mar. 2020.

TECHNICAL FIELD

The invention relates to the field of sealed and thermally insulating tanks, with membranes. In particular, the invention relates notably to the field of the tanks for storing and/or transporting liquefied gas at low temperature, such as tanks for transporting liquefied petroleum gas (also called LPG) which has, for example, a temperature of between −50° C. and 0° C., or for transporting liquefied natural gas (LNG) at approximately −162° C. at atmospheric pressure. These tanks can be installed onshore or on a floating structure. In the case of a floating structure, the tank can be intended for the transportation of liquefied gas or to receive liquefied gas as fuel for the propulsion of the floating structure.

TECHNOLOGICAL BACKGROUND

Sealed and thermally insulating tanks are known, for example from the document WO 2016/001142. Such a tank is situated in a supporting wall, for example the hull of a ship, and fixed thereto. The sealed and thermally insulating tank comprises a structure with multiple layers superposed in a thicknesswise direction comprising a sealing membrane and a thermally insulating barrier arranged between the sealing membrane and the supporting wall.

In order to maximize the operating efficiency of such a tank, it is desirable to optimize the useful cargo volume that can be loaded into the tank and offloaded from the tank. The use of an offloading pump sucking the liquid upward from the tank requires a certain liquid height to be maintained at the bottom of the tank, without which the pump suction member comes into contact with the gaseous phase, which unprimes and/or degrades the pump. That is why it is known practice to produce a sump structure on the bottom wall of such a tank that locally interrupts the sealing membrane, the sump structure comprising a container depressed through the bottom wall of the tank so that the liquid in the container is at the lowest level of the tank. The offloading pump is therefore placed in such a sump structure which makes it possible to maximize the operating efficiency of the tank.

The sealing membrane is therefore tightly welded to the sump structure in order to form a tight continuity of the tank at the sump.

In the case of a sealing membrane comprising corrugations, the corrugations can be deformed to compensate for the thermal contraction or expansion of the sealing membrane. However, the sealing membrane which is fixed to a sump structure must also have the capability to deform in this zone.

This problem applies also to all of the hollow structures running through a tank wall, such as the gas dome or support structure of the loading/offloading derricks.

SUMMARY

One idea on which the invention is based is to improve the fixing of a sealing membrane to a hollow rigid structure, and notably to a sump structure, a vapor collector or a support foot.

According to one embodiment, the invention provides a sealed and thermally insulating tank for the storage of a liquefied gas, the tank comprising a tank wall fixed to a supporting wall, the tank wall comprising a structure with multiple layers superposed in a thicknesswise direction including at least one sealing membrane and at least one thermally insulating barrier arranged between the supporting wall and the sealing membrane, the sealing membrane comprising a plurality of corrugated metal sheets tightly welded to one another, the thermally insulating barrier comprising a plurality of juxtaposed insulating panels each having an inner face which forms a support surface for the sealing membrane, the sealing membrane and the thermally insulating barrier being interrupted in a singular zone by a window, metal anchoring plates being fixed onto the inner faces of the insulating panels and the corrugated metal sheets having edges welded to the anchoring plates to retain the sealing membrane against the support surface, the tank comprising a hollow structure inserted into the window, the hollow structure being arranged through the thickness of the tank wall, wherein the tank comprises a metal closure plate, the metal closure plate comprising an inner edge welded all around the hollow structure, the metal closure plate comprising an outer edge placed under the sealing membrane so as to form an overlap zone, wherein the metal closure plate is tightly welded with the sealing membrane in the overlap zone, and the metal closure plate is left free with respect to the thermally insulating barrier.

By virtue of these features, the metal closure plate makes it possible to produce a tight join between the sealing membrane and the hollow structure. Furthermore, by leaving the metal closure plate free with respect the thermally insulating barrier, that allows the corrugations in proximity to the hollow structure not to be fixed onto a plurality of fixing zones close together. The corrugations can thus be deformed and absorb the thermal expansion and contraction of the tank wall.

According to embodiments, such a tank can comprise one or more of the following features.

According to one embodiment, the tank wall is a bottom wall of the tank.

According to one embodiment, the tank wall is a ceiling wall of the tank.

According to one embodiment, the closure plate comprises at least two portions welded to one another by overlap, preferably precisely two portions.

According to one embodiment, the tank comprises a non-weldable thermal protection coating situated between the metal closure plate and the thermally insulating barrier at least in a zone where the sealing membrane covers the closure plate, to avoid degrading the inner face of the insulating panels by making the weld between the metal closure plate and the sealing membrane.

By virtue of these features, the thermal protection coating, while protecting the insulating panels from the welding temperatures, makes it possible to prevent any accidental weld between the metal closure panel and the thermal insulating barrier.

According to one embodiment, the hollow structure comprises a rigid jacket and a rim protruding outward all around the rigid jacket. According to embodiments, the rigid jacket can constitute a vapor collector, notably in a ceiling wall of the tank, or a support foot for an offloading pump, notably in a bottom wall of the tank.

According to one embodiment, the inner edge of the metal closure plate is welded to the rim of the rigid jacket all around the rigid jacket.

According to one embodiment, the hollow structure comprises a rigid container comprising a lateral wall and a rim protruding outward from the container all around the lateral wall.

According to one embodiment, the inner edge of the metal closure plate is welded to the rim of the container all around the lateral wall of the container.

According to embodiments, the hollow structure forms part of a sump structure or of a gas dome, or even of a support structure for the loading/offloading derricks.

According to one embodiment, the container or the rigid jacket has a cylindrical form, the window of the sealing membrane has a square form and wherein the closure plate has a square form with a dimension of a side of the closure plate greater than a dimension of a side of the window, the closure plate comprising an orifice formed to complement the form of the container or of the rigid jacket.

According to one embodiment, in a zone of the tank away from the singular zone, the sealing membrane has a first series of equidistant parallel rectilinear corrugations extending in a first direction of the plane of the supporting wall and a second series of equidistant parallel rectilinear corrugations extending in a second direction of the plane of the supporting wall, the second direction being at right angles to the first direction, the distance between two adjacent corrugations of the first series and the distance between two adjacent corrugations of the second series being equal to a predetermined corrugation interval io.

According to one embodiment, at least one, some or the corrugated metal sheets have rectangular forms whose sides are parallel respectively to the first direction and the second direction of the plane of the supporting wall and whose dimensions are substantially equal to integer multiples of the corrugation interval io, at least one or each edge of a corrugated metal sheet being situated between two adjacent corrugations parallel to said edge.

According to one embodiment, the closure plate is oriented so as to have one side parallel to the first direction and another side parallel to the second direction, each side being of a dimension less than or equal to 3io, preferably equal to 3io, and wherein the closure plate interrupts at least one, preferably two, corrugations of the sealing membrane in the first direction and at least one, preferably two, corrugations of the sealing membrane in the second direction.

According to one embodiment, in the singular zone, a corrugation directly adjacent to the corrugation interrupted by the closure plate has a singular portion which is offset at a distance from the closure plate with respect to a guideline of said corrugation out of the singular zone, in order not to be interrupted by the closure plate.

Thus, the diverting of certain corrugations in order to avoid being interrupted by the closure plate makes it possible to optimize the flexibility of the sealing membrane, notably to be deformed upon thermal contraction or expansion.

According to one embodiment, the sealing membrane comprises, on either side of the closure plate in the first direction, two notched rectangular corrugated metal sheets having a dimension 1io in the first direction and 7io in the second direction, said notched sheets being symmetrical to one another with respect to an axis of symmetry parallel to the second direction passing through the center of the window, and wherein each notched sheet comprises an inner edge welded to the closure plate and comprising a notching formed to avoid cutting the window, said notching having a dimension of 1io in the first direction and a dimension of 3io in the second direction in order for the notched inner edge to run along the window.

Thus, the notched sheets make it possible to fit the form of the closure plate in order to form an optimal continuity with the membrane.

According to one embodiment, at least one or each of the notched sheets comprises an outer edge opposite the inner edge notched in the first direction, the outer edge being welded to an adjacent corrugated metal sheet by overlap and wherein, at the weld of the outer edge of the notched sheet with the adjacent corrugated metal sheet, the tank comprises a non-weldable thermal protection coating on the thermally insulating barrier.

By virtue of these features, and in the same way as at the overlap between the closure plate and the sealing membrane, the thermal protection coating, while protecting the insulating panels from the welding temperatures, makes it possible to prevent any accidental weld between the notched metal sheet and the adjacent corrugated metal sheet.

According to one embodiment, the thermal protection coating is produced in a composite material comprising at least one layer of glass fiber fixed to, preferably stitched to, an aluminum sheet.

According to one embodiment, the sealing membrane is a primary sealing membrane, the thermally insulating barrier is a primary thermally insulating barrier and the insulating panels are primary insulating panels, wherein the tank wall comprises a secondary thermally insulating barrier situated against the supporting wall and also comprises a secondary sealing membrane situated between the secondary thermally insulating barrier and the primary thermally insulating barrier, wherein the secondary sealing membrane and the secondary thermally insulating barrier being interrupted in the singular zone by the window.

According to one embodiment, the container is a primary container, the rim is a first rim, and the sump structure comprises a rigid secondary container surrounding the primary container so that a bottom part of the primary container is situated in the secondary container, the secondary container comprising a lateral wall and a second rim protruding outward from the secondary container all around the lateral wall of the secondary container, wherein the second rim of the secondary container extends in a plane coinciding with a plane formed by the secondary sealing membrane, the second rim being configured to be tightly fixed to the secondary sealing membrane.

According to one embodiment, the primary thermally insulating barrier comprises a plurality of relaxation slits situated in line with corrugations of the primary sealing membrane and being configured to allow the primary sealing membrane to be deformed without imposing strain on the primary thermally insulating barrier.

According to one embodiment, in the singular zone, the secondary thermally insulating barrier and the secondary container of the sump structure are spaced apart from one another by an adjustment chimney and wherein the primary thermally insulating barrier comprises relaxation slits, at least some of the relaxation slits of the primary thermally insulating barrier being interrupted in the singular zone in line with the adjustment chimney, notably interrupted in the zone where a corrugation of the primary sealing membrane tops the adjustment chimney.

According to one embodiment, the sealing membrane, one of the sealing membranes or the sealing membranes are produced in a metal from among stainless steel, aluminum, Invar®: that is to say an alloy of iron and nickel whose expansion coefficient is typically between $1\times2\cdot10^{-6}$ and $2\times10^{-6}$ $K^{-1}$, or an alloy of iron with high manganese content whose expansion coefficient is of the order of 7 to $9\times10^{-6}$ $K^{-1}$.

According to one embodiment, the hollow structure comprises at least one fixing means arranged to fix the rigid jacket or the container or the second container to the supporting wall at a fixing point of the lateral wall.

According to one embodiment, at least one fixing means is configured to allow a relative displacement of the lateral wall of the container or of the rigid jacket with respect to the supporting wall in a transverse direction at right angles to the lateral wall at the point of fixing of the container or of the rigid jacket, the relative displacement being greater than 1 mm, for example between 1 and 5 mm.

According to one embodiment, the hollow structure comprises a plurality of fixing means distributed regularly or irregularly over the circumference of the container or of the rigid jacket, for example three or four fixing means.

Such a tank can form part of an onshore storage installation, for example for storing LNG, or be installed in a floating, coastal or deep water structure, notably a methane tanker ship, a floating storage and regasification unit (FSRU), a floating production and storage offshore (FPSO) unit and the like. Such a tank can also serve as fuel tank in any type of ship.

According to one embodiment, a ship for transporting a cold liquid product comprises a double hull and an abovementioned tank arranged in the double hull.

According to one embodiment, the invention also provides a transfer system for a cold liquid product, the system comprising the abovementioned ship, insulated pipelines so as to link the tank installed in the hull of the ship to a floating or onshore storage installation and a pump for driving a flow of cold liquid product through the insulated pipelines from the floating or onshore storage installation to or from the tank of the ship.

According to one embodiment, the invention also provides a method for loading or offloading such a ship, in which a cold liquid product is conveyed through insulated pipelines from or to a floating or onshore storage installation to or from the tank of the ship.

BRIEF DESCRIPTION OF THE FIGURES

The invention will be better understood, and other aims, details, features and advantages thereof will become more clearly apparent from the following description of several particular embodiments of the invention, given in a purely illustrative and nonlimiting manner, with reference to the attached drawings.

FIG. 1 represents a schematic view in cross section of a sump structure incorporated in a bottom wall of a tank taken along the line I-I of FIG. 5.

FIG. 2 represents a top view of the bottom wall of the tank where the primary sealing membrane and the sump structure have been omitted.

FIG. 3 represents a top view of the bottom wall of the tank where the primary sealing membrane has been omitted.

FIG. 4 represents a partial view in cross section of the bottom wall of the tank taken along the line IV-IV of FIG. 3.

FIG. 5 represents a top view of the bottom wall of the tank, showing a wider zone than FIGS. 2 and 3.

FIG. 6 is a cut-away schematic representation of a methane tanker and of a loading/offloading terminal for this tank.

DESCRIPTION OF THE EMBODIMENTS

In the description below, a sealed and thermally insulating tank 71 will be described that comprises a sump structure 9 that can be employed in the bottom wall 2 of an LNG storage and/or transportation tank. The bottom wall 2 denotes a wall 2, preferably overall planar, situated in the bottom of the tank with respect to the Earth's field of gravity. The overall geometry of the tank can moreover be of different types. The polyhedral geometries are the most commonplace.

As can be seen in FIG. 1, the tank wall 2 is mounted on a supporting wall 1, produced for example in thick steel sheet such as the internal hull of a ship 70 with a double-hull. The tank wall 2 has a multilayer structure including, in succession, a secondary thermal insulation barrier 6 fixed to the supporting wall 1, for example with beads of mastic inserted between them, a secondary sealing membrane 5 supported by the second thermal insulation barrier 6, a primary thermal insulation barrier 4 covering the secondary sealing membrane 5 and a primary sealing membrane 3 supported by the primary thermal insulation barrier 4. The primary sealing membrane 3 is intended to be in contact with the liquefied natural gas contained in the tank 71.

The thermally insulating barriers 4, 6 can be produced in many ways, in many materials. The secondary thermally insulating barrier 6 comprises a plurality of secondary insulating panels 12 which are anchored to the supporting wall 1 by means of retaining devices (not represented) that are otherwise known. The primary thermally insulating barrier 4 also comprises a plurality of primary insulating panels 11 which are fixed to the secondary insulating panels 12 or to the supporting wall 1 using retaining devices (not represented).

The insulating panels 11, 12 of these thermally insulating barriers 4, 6 together form planar support surfaces 13 for the sealing membranes 3, 5. Such insulating panels 11, 12 are, for example, produced in polyurethane foam blocks. Such insulating panels 11, 12 in the form of polyurethane foam blocks can further comprise a cover plate and/or a bottom plate, for example made of plywood.

As an example, such tanks are described in the patent applications WO14057221 and FR2691520.

According to one embodiment, the secondary sealing membrane 5 is formed from a composite material comprising a sheet of aluminum sandwiched between two glass fiber fabric sheets. The primary sealing membrane 3 is, for its part, obtained by joining together a plurality of corrugated metal sheets 8, welded to one another along their edges, and comprising corrugations 9, 10 extending in two right-angled directions, namely a first series of corrugations 9 and a second series of corrugations 10. The two series of corrugations 9, 10 have a periodic regular or irregular spacing. The metal sheets are, for example, produced from stainless steel or aluminum sheets, shaped by folding or by stamping.

Other details concerning such a corrugated metal membrane are notably described in FR2861060.

In another embodiment, the secondary sealing membrane 5 can also comprise a continuous sheet of metal strakes, with raised edges. The strakes are welded by their raised edges onto parallel weld supports which are fixed in grooves formed on the cover plates of the secondary insulating panels 7, 107. The strakes are, for example, produced from Invar®: that is to say an alloy of iron and nickel whose expansion coefficient is typically between $1.2\times10^{-6}$ and $2\times10^{-6}$ $K^{-1}$. It is also possible to use alloys of iron and manganese whose expansion coefficient is typically of the order of 7 to $9\times10^{-6}$ $K^{-1}$.

FIG. 1 also shows a sump structure 15 inserted into a window 7. The window 7 interrupts the sealing membranes 3, 5 and the thermally insulating barriers 4, 6 in a singular zone. The window 7 is of square form at the primary sealing membrane 3 while it is of circular form at the thermally insulating barriers 4, 6 and the secondary sealing membrane 5 and supporting wall 1.

The sump structure 15 comprises a first container 16 in contact with the interior of the tank 71 and a second container 17 surrounding the bottom part of the first container 16. The first container 16 is connected continuously to the primary sealing membrane 5 using a metal closure plate 23, the first container 16 and the metal closure plate 23 thus tightly completing the primary sealing membrane 3. Likewise, the second container 16 is continuously connected to the secondary sealing membrane 5, that it thus tightly complements.

More specifically, the first container 16 comprises a cylindrical lateral wall 18 whose axis is at right angles to the supporting wall 1. A bottom wall parallel to the supporting wall 1 closes the cylindrical lateral wall 18 in its bottom part. Similarly, the second container 17 comprises a cylindrical lateral wall 18 whose axis is at right angles to the supporting wall 1. A bottom wall parallel to the supporting wall 1 closes the cylindrical lateral wall 18 of the second container 17 in its bottom part. The cylindrical lateral wall 18 of the second container 17 surrounds the cylindrical lateral wall 18 of the first container 16 at a distance therefrom.

Furthermore, the lateral wall 18 of the second container 17 comprises a second rim 20 protruding from the lateral wall 18 all around the latter toward the secondary sealing membrane 5. The edge of the secondary sealing membrane 5 delimiting the window 7 at the secondary sealing membrane 5 is connected tightly to the second rim 20, for example by bonding, the second rim 20 being placed partly under the secondary sealing membrane, as can be seen in FIG. 1.

The lateral wall 18 of the first container 16 comprises a first rim 19 protruding from the lateral wall 18 all around the latter toward the primary sealing membrane 3.

The metal closure plate 23 is composed of two portions welded to one another by overlap. An inner edge 24 of the metal closure plate 23 is tightly welded, that is to say with a continuous weld bead, to the first time 19 all around the lateral wall 18 of the first container 16. Furthermore, the metal closure plate 23 comprises an outer edge 25 placed under the primary sealing membrane 3 so as to form an overlap zone, as represented in FIG. 6. The metal closure plate 23 is thus tightly welded with the primary sealing membrane 3 at the overlap zone. However, the metal closure plate 23 is not fixed to the primary thermally insulating barrier 4. The metal closure plate 23 has, in this embodiment represented, a square form complementing the square window 7 of the primary sealing membrane 3. Furthermore, the metal closure plate 23 comprises an orifice 26 which has a form complementing the first container 16 in order for the outline of the orifice 26 corresponding to the inner edge 24 of the plate to be situated on the first rim 19.

In the tank wall 2, the space contained between the supporting wall 1 and the secondary sealing membrane 5 is a secondary space containing the secondary thermally insulating barrier 6. In the sump structure 15, the space contained between the second container 17 and the supporting wall 1 is also a secondary space. Insulating materials are housed in the secondary space of the sump structure 15 to complete the secondary thermal insulation of the tank wall 2 at the sump structure 15. In fact, the secondary sealing membrane 5 and the secondary container 17 are likely to be in contact with the liquefied gas in case of accidental leakage in the primary sealing membrane 3.

Likewise, the space contained between the secondary sealing membrane 5 and the primary sealing membrane 3 is a primary space containing the primary thermally insulating barrier 4. In the sump structure 15, the space contained between the second container 17 and the first container 16 is also a primary space. Insulating materials are housed in the primary space of the sump structure 15 to complete the primary thermal insulation of the tank wall 2 at the sump structure 15. In fact, the primary sealing membrane 3 and the first container 16 are in contact with the LNG when in use.

There are various insulating materials that may be suitable for thus completing the primary and secondary thermal insulation, for example glass wool or rock wool, polymer foams, notably polyurethane or PVC, balsa, plywood, and the like.

The secondary thermally insulating barrier 6 and the secondary container 17 are spaced apart from one another in order to form an adjustment chimney 34. In the adjustment chimney 34, the secondary sealing membrane 5 is not supported by the secondary thermally insulating barrier 6.

As can be seen by comparing FIGS. 2 and 5, the primary thermally insulating barrier 4 comprises a plurality of relaxation slits 33. The relaxation slits are situated in line with a corrugation 9, 10 of the primary sealing membrane 3 and allow the primary sealing membrane 3 to be deformed without imposing strain on the primary thermally insulating barrier 4. However, to avoid a lack of support for the secondary sealing membrane 5 at the adjustment chimney 34 where the secondary sealing membrane 5 is not supported by the secondary thermally insulating barrier 6, the primary insulating panels 11 do not have relaxation slits 33 under the corrugations 9, 10 of the primary sealing membrane 3. In fact, the secondary sealing membrane 5 which would be located between the adjustment chimney and a relaxation slit would risk being insufficiently held against the flexural deformations by the primary thermally insulating barrier 4 to which the secondary sealing membrane 5 is bonded.

FIG. 2 represents a top view of the bottom wall 2 where the sump structure 15 and the primary sealing membrane 3 have been omitted to better see the structure of the bottom wall under these elements.

As represented in FIG. 2, a non-weldable thermal protection coating 27 is situated between the metal closure plate 23 and the primary thermally insulating barrier 4. The thermal protection coating 27 situated under the closure plate 23 can have a form similar to the form of the closure plate 23 to ensure the thermal protection of the primary insulating panels as illustrated in FIG. 2. However, the thermal protection coating 27 can also be of a size greater than the closure plate 23 as represented in FIG. 4. This coating can be made of a composite material like the abovementioned secondary sealing membrane 5.

Metal anchoring plates 14 are fixed onto the inner faces of the primary insulating panels 11, for example screwed or riveted, in order for the edges of the corrugated metal sheets 8 to be welded to the anchoring plates 14 and thus secure the primary sealing membrane 3 to the primary thermally insulating barrier 4. These metal anchoring plates 14 are notably illustrated in FIGS. 2 and 3.

FIG. 3 represents a top view of the bottom wall 2 where, this time, only the primary sealing membrane 3 has been omitted. In this figure, it is therefore possible to see the placement of the metal closure plate 23 on the primary thermally insulating barrier 4.

FIG. 4 represents a cross-sectional view of the wall of FIG. 3 where it can be seen that the metal closure plate 23 is therefore supported in one part by the first rim 19 of the first container 16 and in the other part by the primary thermally insulating barrier 4.

As represented in FIG. 5, a top view of a bottom wall 2 shows the arrangement of the primary sealing membrane 3 around a sump structure 15 in the singular zone.

In a zone of the tank 71 away from the sump structure 15, that is to say a regular zone, the primary sealing membrane 3 has a first series of equidistant parallel rectilinear corrugations 9 extending in a first direction of the plane of the supporting wall and a second series of equidistant parallel rectilinear corrugations 10 extending in a second direction of the plane of the supporting wall. The second direction is at right angles to the first direction such that the two series of corrugations 9, 10 cross at right angles. The distance between two adjacent corrugations of the first series 9 and the distance between two adjacent corrugations of the second series 10 are equal to a predetermined corrugation interval io, represented by the symbol 28.

The corrugated metal sheets 8 have rectangular forms whose sides are parallel respectively to the first direction and the second direction of the plane of the supporting wall 1 and whose dimensions are substantially equal to integer multiples of the corrugation interval io.

In the singular zone around the sump structure 15, the closure plate 23 is oriented so as to have one side parallel to the first direction and another side parallel to the second direction. Furthermore, each side of the closure plate 23 is of a dimension equal to 3io. As can be seen in FIG. 5, the closure plate 23 interrupts two corrugations 9 of the primary sealing membrane 3 in the first direction and two corrugations 10 of the primary sealing membrane 3 in the second direction.

Given the size of the closure plate 23, the sump structure 15 could interrupt four corrugations in each of the directions which would reduce the flexibility of the primary sealing membrane 3 in the singular zone. To avoid that, the corrugations 9, 10 directly adjacent to the corrugations interrupted by the closure plate 23 have a singular portion 29 which is offset at a distance from the closure plate 23 with respect to a guideline of said corrugation out of the singular zone. In fact, the singular portions 29 of the waves that are offset are diverted from their guideline using wave diversion elements 30, as illustrated in FIG. 5.

Furthermore, the primary sealing membrane 3 comprises, on either side of the closure plate 23 in the first direction, two notched rectangular corrugated metal sheets 31 having a dimension 1io in the first direction and 7io in the second direction. The notched sheets 31 are symmetrical to one another with respect to an axis of symmetry parallel to the second direction passing through the center of the window 7. The notched sheets comprise an inner edge welded to the closure plate 23 and a notching 32 formed to avoid cutting the window 7 and in order to fit the form of the closure plate 23 with an overlap allowing the weld between the notched sheets and the closure plate. The notching 32 has a dimension of 1io in the first direction and a dimension of 3io in the second direction.

The notched metal sheets 31 comprise an outer edge opposite the notched inner edge in the first direction. The outer edge is welded to an adjacent corrugated metal sheet 8 by overlap. At the weld of the outer edge of the notched sheet 31 with the adjacent corrugated metal sheet 8, a non-weldable thermal protection coating 27 is placed on the primary thermally insulating barrier 4 as can be seen in FIGS. 2 and 3. In fact, the notched sheet 31 has only a single corrugation 10 in the second direction because of its dimension. To allow this corrugation 10 to be deformed in case of thermal expansion or contraction, it is preferable for the notched sheet 31 not to be fixed to the primary thermally insulating barrier 4 too closely. The thermal protection coating 27 here also acts as protection against the high welding temperatures for the primary thermally insulating barrier 4.

In an embodiment suitable for less cold gas, the secondary sealing membrane and the secondary thermally insulating barrier could be eliminated.

The technique which has been described above to produce the link between a primary sealed membrane and a sump structure can also be used around any other hollow structure extending thicknesswise in the tank wall, for example a gas collector or a support foot, in different types of tanks, for example in a tank having a single sealed membrane, a tank with double membrane for liquefied natural gas (LNG) in an onshore installation or in a floating structure such as a methane tanker or the like.

Referring to FIG. 6, a cut-away view of a methane tanker ship 70 shows a sealed and insulated tank 71 of generally prismatic form mounted in the double hull 72 of the ship. The wall of the tank 71 comprises a primary sealed barrier intended to be in contact with the LNG contained in the tank, a secondary sealed barrier arranged between the primary sealed barrier and the double hull 72 of the ship, and two insulating barriers arranged respectively between the primary sealed barrier and the secondary sealed barrier and between the secondary sealed barrier and the double hull 72.

As is known per se, loading/offloading pipelines 73 arranged on the top deck of the ship can be connected, by means of appropriate connectors, to a maritime or port terminal to transfer a cargo of LNG from or to the tank 71.

FIG. 6 represents an example of maritime terminal comprising a loading and offloading station 75, a submarine line 76 and an onshore installation 77. The loading and offloading station 75 is a fixed off-shore installation comprising a mobile arm 74 and a riser 78 which supports the mobile arm 74. The mobile arm 74 bears a bundle of insulated flexible pipes 79 that can be connected to the loading/offloading pipelines 73. The orientable mobile arm 74 adapts to all methane tanker templates. A link line that is not represented extends inside the riser 78. The loading and offloading station 75 allows the loading and the offloading of the methane tanker 70 from or to the onshore installation 77. The latter comprises liquefied gas storage tanks 80 and link lines 81 linked by the submarine line 76 to the loading or offloading station 75. The submarine line 76 allows transfer of the liquefied gas between the loading or offloading station 75 and the onshore installation 77 over a great distance, for example 5 km, which makes it possible to keep the methane tanker ship 70 at a great distance from the coast during the loading and offloading operations.

To generate the pressure necessary to the transfer of the liquefied gas, pumps embedded in the ship 70 and/or pumps with which the onshore installation 77 is equipped and/or pumps with which the loading and offloading station 75 is equipped are implemented.

Although the invention has been described in relation to a number of particular embodiments, it is perfectly clear that it is in no way limited thereto and that it encompasses all the technical equivalents of the means described and the combinations thereof provided they fall within the context of the invention.

The use of the verb "comprise" or "include" and its conjugated forms does not preclude the presence of elements or steps other than those stated in a claim.

In the claims, any reference symbol between parentheses should not be interpreted as a limitation of the claim.

The invention claimed is:

1. A sealed and thermally insulating tank (71) for the storage of a liquefied gas, the tank (71) comprising a tank wall (2) fixed to a supporting wall (1), the tank wall comprising a structure with multiple layers superposed in a thicknesswise direction including at least one sealing membrane (3) and at least one thermally insulating barrier (4) arranged between the supporting wall and the sealing member (3), the sealing membrane (3) comprising a plurality of corrugated metal sheets (8) tightly welded to one another, the thermally insulating barrier (4) comprising a plurality of juxtaposed insulating panels (11) each having an inner face which forms a support surface (13) for the sealing membrane (3), the sealing membrane (3) and the thermally insulating barrier (4) being interrupted in a singular zone by a window (7), metal anchoring plates (14) being fixed onto the inner faces of the insulating panels (11) and the corrugated metal sheets (8) having edges welded to the anchoring plates (14) to retain the sealing membrane (3) against the support surface (13), the tank comprising a hollow structure (15) inserted into the window (7), the hollow structure (15) being arranged through the thickness of the tank wall (2), wherein the tank (71) comprises a metal closure plate (23), the metal closure plate (23) comprising an inner edge (24) welded all around the hollow structure (15), the metal closure plate (23) comprising an outer edge (25) placed under the sealing membrane (3) so as to form an overlap zone, wherein the metal closure plate (23) is tightly welded with the sealing membrane (3) in the overlap zone, and the metal closure plate (23) is left free with respect to the thermally insulating barrier (4).

2. The tank as claimed in claim 1, wherein the tank comprises a non-weldable thermal protection coating (27) situated between the metal closure plate (23) and the thermally insulating barrier (4) at least in a zone where the sealing membrane (3) covers the closure plate (23), to avoid degrading the inner face of the insulating panels (11) by making the weld between the metal closure plate (23) and the sealing membrane (3).

3. The tank as claimed in claim 2, wherein the thermal protection coating (27) is produced in a composite material comprising at least one layer of glass fiber fixed to an aluminum sheet.

4. The tank as claimed in claim 1, wherein the hollow structure is a sump structure (15), the sump structure (15) comprising a rigid container (16) comprising a lateral wall (18) and a rim (19) protruding outward from the container (16) all around the lateral wall (18), the inner edge (24) of the metal closure plate (23) being welded to the rim (19) of the container (16) all around the lateral wall (18) of the container (16).

5. The tank as claimed in claim 4, wherein the container (16) has a cylindrical form, the window (7) of the sealing membrane (3) has a square form and wherein the closure plate (23) has a square form with a dimension of a side of the closure plate (23) greater than a dimension of a side of the window (7), the closure plate (23) comprising an orifice formed so as to complement the form of the container (16).

6. The tank as claimed in claim 1, wherein, in a zone of the tank away from the singular zone, the sealing membrane (3) has a first series of equidistant parallel rectilinear corrugations (9) extending in a first direction of the plane of the supporting wall and a second series of equidistant parallel rectilinear corrugations (10) extending in a second direction of the plane of the supporting wall, the second direction being at right angles to the first direction, the distance between two adjacent corrugations of the first series (9) and the distance between two adjacent corrugations of the second series (10) being equal to a predetermined corrugation interval io (28).

7. The tank as claimed in claim 6, wherein the corrugated metal sheets (8) have rectangular forms whose sides are parallel respectively to the first direction and the second direction of the plane of the supporting wall and whose dimensions are substantially equal to integer multiples of the corrugation interval io, each edge of a corrugated metal sheet (8) being situated between two adjacent corrugations parallel to said edge.

8. The tank as claimed in claim 7, wherein the closure plate (23) is oriented so as to have one side parallel to the first direction and another side parallel to the second direction, each side being of a dimension equal to 3io, and wherein the closure plate (23) interrupts two corrugations of the sealing membrane (3) in the first direction and two corrugations of the sealing membrane (3) in the second direction.

9. The tank as claimed in claim 6, wherein, in the singular zone, a corrugation directly adjacent to the corrugation interrupted by the closure plate (23) has a singular portion (29) which is offset away from the closure plate (23) with respect to a guideline of said corrugation out of the singular zone, in order not to be interrupted by the closure plate (23).

10. The tank as claimed in claim 6, wherein the sealing membrane (3) comprises, on either side of the closure plate (23) in the first direction, two notched rectangular corrugated metal sheets (31) of dimension 1io in the first direction and 7io in the second direction, said notched sheets (31) being symmetrical to one another with respect to an axis of symmetry parallel to the second direction passing through the center of the window (7), and wherein each notched sheet (31) comprises an inner edge welded to the closure plate (23) and comprising a notching (32) formed to avoid cutting the window (7), said notching (32) having a dimension of 1io in the first direction and a dimension of 3io in the second direction in order for the notched inner edge to run along the window (7).

11. The tank as claimed in claim 10, wherein each notched sheet (31) comprises an outer edge opposite the notched inner edge in the first direction, the outer edge being welded to an adjacent corrugated metal sheet (8) by overlap and wherein, at the weld of the outer edge of the notched sheet (31) with the adjacent corrugated metal sheet (8), the tank comprises a non-weldable thermal protection coating (27) on the thermally insulating barrier (4).

12. The tank as claimed in claim 1, wherein the sealing membrane (3) is a primary sealing membrane, the thermally insulating barrier (4) is a primary thermally insulating barrier and the insulating panels (11) are primary insulating panels, wherein the tank wall comprises a secondary thermally insulating barrier (6) situated against the supporting wall and also comprises a secondary sealing membrane (5)

situated between the secondary thermally insulating barrier (6) and the primary thermally insulating barrier (4), wherein the secondary sealing membrane (5) and the secondary thermally insulating barrier (6) being interrupted in the singular zone by the window (7).

13. The tank as claimed in claim 1, wherein the hollow structure is a sump structure (15), the sump structure (15) comprising a rigid container (16) comprising a lateral wall (18) and a rim (19) protruding outward from the container (16) all around the lateral wall (18), the inner edge (24) of the metal closure plate (23) being welded to the rim (19) of the container (16) all around the lateral wall (18) of the container (16), wherein the sealing membrane (3) is a primary sealing membrane, the thermally insulating barrier (4) is a primary thermally insulating barrier and the insulating panels (11) are primary insulating panels, wherein the tank wall comprises a secondary thermally insulating barrier (6) situated against the supporting wall and also comprises a secondary sealing membrane (5) situated between the secondary thermally insulating barrier (6) and the primary thermally insulating barrier (4), wherein the secondary sealing membrane (5) and the secondary thermally insulating barrier (6) being interrupted in the singular zone by the window (7), and wherein the container (16) is a primary container, the rim (19) is a first rim, and the sump structure (15) comprises a rigid secondary container (17) surrounding the primary container (16) so that a bottom part of the primary container (16) is situated in the secondary container (17), the secondary container (17) comprising a lateral wall (18) and a second rim (20) protruding outward from the secondary container (16) all around the lateral wall (18) of the secondary container (17), wherein the second rim (20) of the secondary container (17) extends in a plane coinciding with a plane formed by the secondary sealing membrane (5), the second rim (20) being configured to be tightly fixed to the secondary sealing membrane (5).

14. The tank as claimed in claim 13, wherein, in the singular zone, the secondary thermally insulating barrier (6) and the secondary container (16) of the sump structure (15) are spaced apart from one another by an adjustment chimney (34) and wherein the primary thermally insulating barrier comprises relaxation slits (33), at least some of the relaxation slits (33) of the primary thermally insulating barrier (4) being interrupted in the singular zone in line with the adjustment chimney (34).

15. A ship (70) for transporting a cold liquid product, the ship comprising a double hull (72) and a tank as claimed in claim 1 arranged in the double hull (72).

16. A transfer system for a cold liquid product, the system comprising a ship (70) as claimed in claim 15, insulated pipelines (73, 79, 76, 81) arranged so as to link the tank (71) installed in the hull of the ship to a floating or onshore storage installation (77) and a pump for driving a flow of cold liquid product through the insulated pipelines from or to the floating or onshore storage installation to or from the tank of the ship.

17. Method for loading or offloading a ship (70) as claimed in claim 15, wherein a cold liquid product is conveyed through insulated pipelines (73, 79, 76, 81) from or to a floating or onshore storage installation (77) to or from the tank of the ship (71).

* * * * *